US009500970B2

(12) United States Patent
Nomura et al.

(10) Patent No.: US 9,500,970 B2
(45) Date of Patent: Nov. 22, 2016

(54) TONER

(71) Applicant: CANON KABUSHIKI KAISHA, Tokyo (JP)

(72) Inventors: Shotaro Nomura, Suntou-gun (JP); Masami Fujimoto, Suntou-gun (JP); Katsuhisa Yamazaki, Numazu (JP); Kouji Nishikawa, Susono (JP); Daisuke Yoshiba, Suntou-gun (JP); Hiroki Akiyama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/446,729

(22) Filed: Jul. 30, 2014

(65) Prior Publication Data

US 2015/0037721 A1 Feb. 5, 2015

(30) Foreign Application Priority Data

Jul. 31, 2013 (JP) ..... 2013-159296

(51) Int. Cl.

| | |
|---|---|
| ***G03G 9/083*** | (2006.01) |
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0819* (2013.01); *G03G 9/08* (2013.01); *G03G 9/081* (2013.01); *G03G 9/083* (2013.01); *G03G 9/0815* (2013.01); *G03G 9/0821* (2013.01); *G03G 9/0827* (2013.01); *G03G 9/0833* (2013.01); *G03G 9/08755* (2013.01); *G03G 9/09716* (2013.01)

(58) Field of Classification Search

CPC ..... G03G 9/09716; G03G 9/09708; G03G 9/09725; G03G 9/083; G03G 9/0821

See application file for complete search history.

(56) References Cited

U.S. PATENT DOCUMENTS

| | | | | |
|---|---|---|---|---|
| 5,302,483 | A * | 4/1994 | Yamane | G03G 5/08214 430/108.1 |
| 2004/0058258 | A1 | 3/2004 | Yoshino | |
| 2005/0089779 | A1 | 4/2005 | Matsumoto | |
| 2015/0125790 | A1 * | 5/2015 | Hotta | G03G 9/083 430/108.3 |

FOREIGN PATENT DOCUMENTS

| | | | |
|---|---|---|---|
| JP | 2013-092748 | A | 5/2013 |
| WO | 2013/063291 | A1 | 5/2013 |

* cited by examiner

*Primary Examiner* — Janis L Dote

(74) *Attorney, Agent, or Firm* — Canon U.S.A., Inc. IP Division

(57) ABSTRACT

Provided is a toner that has excellent low-temperature fixability and is capable of obtaining an image having a stable image density, in which the occurrence of image defects is suppressed. The toner includes toner base particles, each of which contains a binder resin and a magnetic material, and organic-inorganic composite fine particles on each of the toner base particles. Each of the organic-inorganic composite fine particles comprises a vinyl resin particle, and inorganic fine particles which are embedded in the vinyl resin particle, and at least a part of which are exposed. The volumetric specific heat of the organic-inorganic composite fine particles and the volumetric specific heat of the toner base particles satisfy a predetermined provision.

10 Claims, 1 Drawing Sheet

TONER

BACKGROUND OF THE INVENTION

Field of the Invention

The present invention relates to a toner used in an electrophotographic method, an electrostatic recording method, a magnetic recording method and the like.

Description of the Related Art

With the increasing speed and longer life of an electrophotographic apparatus, a toner needs to have resistance to a physical load.

From the perspective of increasing the resistance of a toner to a physical load, investigation has previously been carried out into hindering an external additive present on the toner surface from becoming embedded in the toner surface. The embedding of an external additive in the toner surface occurs during image formation of a plurality of sheets, for example, causing toner fluidity to deteriorate, charge performance to deteriorate, and the physical adhesive strength to increase. Consequently, developing properties deteriorate, so that image defects occur, density deteriorates, and parts are welded together.

To hinder an external additive from embedding in the toner surface, many attempts have been made that use an external additive having a large particle diameter. WO2013/063291 and Japanese Patent Application Laid-Open No. 2013-92748 discuss using organic-inorganic composite fine particles as an external additive having a large particle diameter.

Investigation by the inventors showed that the addition of the inorganic fine particles having a large particle diameter like those discussed in WO2013/063291 and Japanese Patent Application Laid-Open No. 2013-92748 has an effect on toner low-temperature fixability. It is thought that the increase of the inorganic fine particles having a large particle diameter makes the gaps among the toner particles large, which inhibits toner melding caused by thermal fusion and fixing of the toner to the paper. Further, to cover a certain area of the toner surface with an external additive having a large particle diameter, the volume of the added external additive increases. In this case, the heat capacity as an external additive increases, so that it becomes difficult to supply thermal energy sufficient for the fusing of the toner base particles during fixing. This point is also thought to be a reason for deterioration in low-temperature fixability.

As described above, it is difficult to achieve low-temperature fixability while also maintaining developing properties during image formation of a large number of sheets. The achievement of both of these properties has been a long-standing problem for electrophotographic apparatuses.

Further, since the adhesive strength of the external additive to the toner surface is reduced by the increase in grain size, an external additive having a large particle diameter tends to detach from the toner, which causes the problem that the parts become contaminated by the external additive having a large particle diameter during prolonged use.

Thus, although the addition of an external additive having a large particle diameter is effective as a measure to increase speed and achieve longer life, many problems still remain. Accordingly, further measures are required.

SUMMARY OF THE INVENTION

The present invention is directed to providing a toner that can solve the above-described problems.

Specifically, the present invention is directed to providing a toner that:

i) has excellent low-temperature fixability; and ii) can obtain an image having a stable image density, in which deterioration in developing properties is suppressed, and the occurrence of image defects due to parts contamination and welding is suppressed, even after a large number of sheets have been printed out.

According to an aspect of the present invention, a toner includes toner base particles, each of which contains a binder resin and a magnetic material, and organic-inorganic composite fine particles on each of the toner base particles, wherein each of the organic-inorganic composite fine particles comprises a vinyl resin particle, and inorganic fine particles which are embedded in the vinyl resin particle, and at least a part of which are exposed, wherein the toner base particles have a volumetric specific heat at 80° C. of 3,450 kJ/($m^3$·° C.) or more to 4,200 kJ/($m^3$·° C.) or less, wherein the organic-inorganic composite fine particles have a volumetric specific heat at 80° C. of 2,900 kJ/($m^3$·° C.) or more to 4,200 kJ/($m^3$·° C.) or less, and a number average particle diameter of 50 nm or more to 200 nm or less, and wherein an absolute difference between the volumetric specific heat at 80° C. of the toner base particles and the volumetric specific heat at 80° C. of the organic-inorganic composite fine particles is 740 kJ/($m^3$·° C.) or less.

Further features of the present invention will become apparent from the following description of exemplary embodiments with reference to the attached drawings.

DESCRIPTION OF THE EMBODIMENTS

Figure 1A:
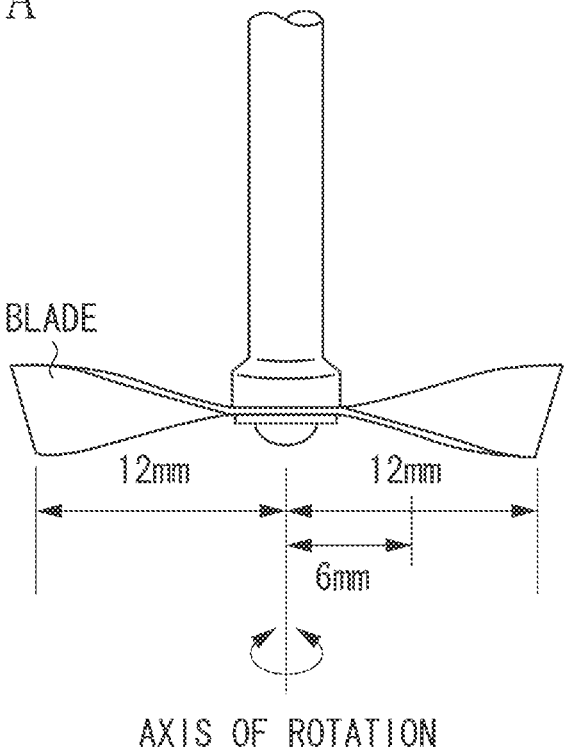
FIGS. 1A and 1B are schematic diagrams of a propeller-type blade with a 23.5 mm diameter that is specifically for FT-4 measurement.

Various exemplary embodiments, features, and aspects of the invention will be described in detail below with reference to the drawings.

The present invention relates to a toner includes toner base particles, each of which contains a binder resin and a magnetic material, and organic-inorganic composite fine particles on each of the toner base particles. Each of the organic-inorganic composite fine particles comprises a vinyl resin particle, and inorganic fine particles which are embedded in the vinyl resin particle, and at least a part of which are exposed. The toner base particles have a volumetric specific heat at 80° C. of 3,450 kJ/($m^3$·° C.) or more to 4,200 kJ/($m^3$·° C.) or less. The organic-inorganic composite fine particles have a volumetric specific heat at 80° C. of 2,900 kJ/($m^3$·° C.) or more to 4,200 kJ/($m^3$·° C.) or less, and a number average particle size of 50 nm or more to 200 nm or less. An absolute difference between the volumetric specific heat at 80° C. of the toner base particles and the volumetric specific heat at 80° C. of the organic-inorganic composite fine particles is 740 kJ/($m^3$·° C.) or less.

According to investigation by the inventors, by using a toner such as that described above, regardless of the usage environment, an image having a stable image density can be obtained in which the occurrence of image defects due to parts contamination and welding is suppressed, even after a large number of sheets have been printed out. Further, the toner according to the present invention has excellent low-temperature fixability, and can be fixed at low temperatures.

As stated above, although the addition of inorganic fine particles having a large particle diameter to the toner base particles as an external additive is an effective measure to increase speed and achieve longer life, the use of such an external additive causes deterioration in low-temperature fixability and parts contamination.

As a result of diligent research by the inventors, it was discovered that the above problems can be solved by setting the volumetric specific heat of the external additive having a large particle diameter (hereafter referred to as a large external additive) and the toner base particles to a specific range, and selecting the specific nature and structure of a large external additive. This will now be described in more detail below.

First, two mechanisms are involved in inhibition of fixability of a large external additive, that is, a physical mechanism and a thermal mechanism.

The physical cause is that the expansion of the gaps among toner particles caused by the large external additive makes it more difficult for heat and pressure to be transmitted between the toner particles during fixing, which inhibits the fusing and melding of the toner particles.

The thermal cause is that if a large external additive is added to cover a certain level of the toner surface in order to obtain a desired effect, the heat capacity of the external additive increases, which makes it more difficult to impart a sufficient amount of heat to the whole toner during fixing.

The former cause is an unavoidable phenomenon due to the fact that the external additive is a large external additive. Accordingly, the inventors focused on the latter cause, and tried to find improvements. Specifically, the inventors investigated the nature and structure of external additives that are less likely to inhibit the fusion and melding of the toner base structure.

As a result of these investigations, the inventors reached the conclusion that rather than conventional inorganic fine particles represented by silica and resin fine particles such as acrylic, organic-inorganic composite fine particles that are formed from both of these have the optimal structure in terms of the nature of the large external additive.

Some large inorganic fine particles that have been conventionally used are capable of imparting a high level of charging properties and fluidity to a toner. However, since inorganic fine particles have a poor affinity with a binder resin, a clear boundary remains between the dissolved resin binder and the inorganic fine particles. Consequently, rapid melding between the toner particles is inhibited. Consequently, when inorganic fine particles are used as the large external additive, low-temperature fixability inevitably deteriorates.

On the other hand, when resin fine particles are used as the large external additive, the ability to impart charging properties and fluidity to the toner is poorer than when inorganic fine particles are used.

However, it was learned that when organic-inorganic composite fine particles are used, the melding of the toner particles is not inhibited during fixing, while good fluidity and charging properties are maintained. Especially, it was learned that it is important that the composite structure of the organic material and the inorganic material is a structure in which the inorganic fine particles are embedded in a vinyl resin particle, and at least a part of the inorganic fine particles are exposed to the surface of the vinyl resin particle. In addition, a structure having convex portions derived from the inorganic fine particles on the surface of the vinyl resin particle is desirable. It is sufficient for the inorganic fine particles to be present on the surface of the vinyl resin particle, it is not necessary for the inorganic fine particles to be present inside the vinyl resin particle.

For example, if the surface of the inorganic fine particles is completely covered by an organic material, the surface properties of those composite particles are predominantly determined by the behavior of the organic material, so that the same problems occur as the problems that resin fine particles cause. Conversely, if the surface of the resin fine particles is completely covered by an inorganic material, the same problems occur as the problems that inorganic fine particles cause. Consequently, for the organic-inorganic composite fine particles, organic-inorganic composite fine particles capable of simultaneously exhibiting both the properties of the organic material and the inorganic material are optimal, so that the above structure is best.

In addition, the inventors focused on the volumetric specific heat of the external additive as an index indicating the thermal properties of the external additive particles. The volumetric specific heat (kJ/(m$^3$·° C.)) is the amount of heat required to increase the temperature of a substance per unit volume by 1° C.

Although "specific heat" typically refers to the amount of heat required to increase the temperature of a substance per unit mass by 1° C., the inventors considered that basing on "volume (capacity)" is more appropriate, and thus in the present invention "volumetric specific heat" is employed as an index.

First, the inventors thought that a sufficient low-temperature fixability as a toner could be achieved without inhibiting the thermal fusion of the toner base particles during fixing if the volumetric specific heat of the external additive is sufficiently low. This is because when a predetermined amount of heat is externally applied, the smaller the volumetric specific heat the faster the increase in temperature, so that the toner particles can be fused more rapidly.

Further, the relationship in the volumetric specific heat of the external additive and the toner base particles is also important. Based on investigations by the inventors, it was learned that the absolute difference between the volumetric specific heat ($C_{v\text{-}t}$) (kJ/(m$^3$·° C.)) of the toner base particles and the volumetric specific heat ($C_{v\text{-}a}$) (kJ/(m$^3$·° C.)) of the organic-inorganic composite fine particles needs to be 740 kJ/(m$^3$·° C.) or less. Namely, the following formula needs to be satisfied.

$$|C_{v\text{-}t}-C_{v\text{-}a}\leq 740|$$

If the difference in volumetric specific heat of the toner base particles and the organic-inorganic composite fine particles, which are an external additive, is too large, various problems occur due to the non-uniformity of volumetric specific heat.

If $C_{v\text{-}t}-C_{v\text{-}a}>740$, this means that the capability with which the external additive follow changes in heat is substantially higher than the capability with which the toner base particles follow changes in heat. In such a case, in the fixing step, since the temperature of the external additive tends to increase more easily, if an amount of heat for sufficiently fusing the toner particles is applied, an excessive deterioration in viscosity occurs at just the resin on the surface of the toner base particles where the external additive is present, which causes problems such as hot offset. On the other hand, if the amount of supplied heat in the fixing step is suppressed in consideration of the heat capacity of the external additive, it is difficult for the middle of the toner to be sufficiently fused, so that melding of the toner base particles does not sufficiently occur, which leads to a deterioration in low-temperature fixability.

Further, if $C_{v\text{-}a}-C_{v\text{-}t}>740$, this means that the capability with which the toner base particles follow changes in heat is substantially higher than the capability with which the external additive follows changes in heat. In such a case, in the fixing step, since the temperature of the external additive does not increase even if an amount of heat for sufficiently fusing the toner particles is applied, the toner base particles do not sufficiently meld together, so that low-temperature fixability deteriorates. On the other hand, if an amount of heat capable of sufficiently increasing the temperature of the external additive is applied, it is more difficult for the temperature of the fixed toner image to decrease, which causes problems such as the sticking together of the discharged sheets.

To suppress the occurrence of problems such as those described above, it is necessary to perform control so that the volumetric specific heat of the external additive is in a comparatively near range to the volumetric specific heat of the toner particles. Since the toner base particles according to the present invention are composite particles containing a binder resin and a magnetic material, using organic-inorganic composite fine particles allows the volumetric specific heat to be controlled to within a close range of the toner base particles. From this point too, organic-inorganic composite fine particles are desirable as the external additive.

It is important that the organic-inorganic composite fine particles used as an external additive in the toner according to the present invention have a number average particle diameter of 50 nm or more to 200 nm or less.

If the number average particle diameter of the organic-inorganic composite fine particles is within this range, the organic-inorganic composite fine particles are less likely to become embedded in the toner base particles, which enables the flow performance and the charge performance of the toner to be maintained for a long period even if a strong physical load is applied during a faster and longer life electrophotographic process. It is desirable that the number average particle diameter is 70 nm or more to 130 nm or less, because these advantageous effects are exhibited even better.

It is important that the volumetric specific heat at 80° C. of the organic-inorganic composite fine particles serving as an external additive is 2,900 kJ/($m^3$·° C.) or more to 4,200 kJ/($m^3$·° C.) or less. If the volumetric specific heat of the organic-inorganic composite fine particles is within this range, because the fusion of the toner particles is not inhibited during fixing, the flow performance and the charge performance of the toner can be maintained without hindering the low-temperature fixability of the toner particles. It is desirable that this volumetric specific heat is 3,100 kJ/($m^3$·° C.) or more to 4,200 kJ/($m^3$·° C.) or less, because these advantageous effects are exhibited even better.

The volumetric specific heat of the organic-inorganic composite fine particles can be adjusted by changing the type of inorganic fine particles and by changing the amount of inorganic fine particles with respect to the vinyl resin fine particles.

Although the volumetric specific heat is a thermal property value that changes according to the temperature of the substance, in view of the temperature of the paper during a thermal fixing step in a typical printer or copying machine, the inventors considered that 80° C. would be the optimal value in terms of expressing the thermal changes of the toner. For that reason, the present invention prescribes the volumetric specific heat at 80° C.

Further, it is important that the volumetric specific heat at 80° C. of the toner base particles is 3,450 kJ/($m^3$·° C.) or more to 4,200 kJ/($m^3$·° C.) or less. If the volumetric specific heat of the toner base particles is within this range, even during a faster and longer life electrophotographic process, the toner rapidly thermally fuses even during the fixing process, and low-temperature fixability can be exhibited without causing any problems such as welding. In addition, deterioration in fluidity caused by the embedding of the external additive is suppressed, and the occurrence of conveyance problems of the toner which is conveyed to the developing sleeve are also suppressed. These advantageous effects are exhibited even more remarkably if the volumetric specific heat is 3,600 kJ/($m^3$·° C.) or more to 4,000 kJ/($m^3$·° C.) or less.

The volumetric specific heat of the toner base particles can be adjusted by changing the type of binder resin and magnetic material, and by changing the amount of the magnetic material with respect to the binder resin.

Thus, if the volumetric specific heat of the toner base particles, the volumetric specific heat of the organic-inorganic composite fine particles, and the difference between these values satisfy the above-described ranges, stable image density can be obtained without causing image defects due to parts contamination and parts welding even during prolonged use. Further, this simultaneously enables excellent low-temperature fixability to be exhibited.

As described above, it is important that the composite structure of the organic material and the inorganic material is a structure in which the inorganic fine particles are embedded in a vinyl resin particle, and the inorganic fine particles are exposed to the surface of the vinyl resin particle. In addition, a structure having convex portions derived from the inorganic fine particles on the surface of the vinyl resin particle is desirable.

Further, it is desirable that the organic-inorganic composite fine particles having the above structure have a shape factor SF-1 measured using an enlarged image of the organic-inorganic composite fine particles captured using a scanning electron microscope of 100 or more to 150 or less. More desirably, the shape factor SF-1 is 110 or more to 140 or less. The shape factor SF-1 is an index indicating the degree of roundness of the particles. If the value is 100, the particle is a perfect circle, and the greater the value is, the further the shape is away from a circle, indicating an irregular shape.

It is desirable that the organic-inorganic composite fine particles have a shape factor SF-2 measured using an enlarged image of the organic-inorganic composite fine particles captured using a scanning electron microscope of 103 or more to 120 or less. The shape factor SF-2 is an index indicating the level of concavities and convexities of the particles. If the value is 100, the particle is a perfect circle, and the greater the value is, the greater the level of concavities and convexities.

If SF-1 and SF-2 are within the above ranges, the organic-inorganic composite fine particles are anchored to the toner surface due to the surface having appropriate concavities and convexities. Consequently, the organic-inorganic composite fine particles present at the convex portions of the toner base particle surface continue to be held by convex portions even if the toner particles are stirred for a prolonged period so that they repeatedly collide with each other. As a result, a phenomenon in which the organic-inorganic composite fine particles are locally collected in the concave portions of the toner base particle surface is less likely to occur. Consequently, problems such as the toner fused to parts due to exposure of a surface of the toner base particles, which have high adhesive properties, deterioration in fluidity caused by toner clumps, and deterioration in the charging properties due to localized absorption of moisture are suppressed.

Further, the toner base particles desirably have an average circularity of 0.950 or more to 0.965 or less. It is desirable that the average circularity of the toner base particles is within this range, because the organic-inorganic composite fine particles appropriately interlock with the surface concavities and convexities, which makes it more difficult for the organic-inorganic composite fine particles to be swept into the concave portions on the toner surface and become unevenly distributed even during prolonged use.

It is desirable that the organic-inorganic composite fine particles serving as an external additive are added in an amount of 0.50 parts by mass or more to 2.00 parts by mass or less based on 100 parts by mass of toner base particles. If the added amount of the organic-inorganic composite fine particles is within this range, sufficient charging properties and fluidity can be imparted to the toner even for a faster and longer-life apparatus configuration without inhibiting low-temperature fixability. If the added amount of the organic-inorganic composite fine particles is 0.75 parts by mass or more to 1.50 parts by mass or less, these advantageous effects are even more remarkable.

It is desirable that the toner according to the present invention including the organic-inorganic composite fine particles as an external additive has a maximum tensile stress of 0.40 N or more to 0.60 N or less. This maximum tensile stress is the stress required to fracture a toner layer formed by applying on the toner a compressive stress of 8 $kg/cm^2$. If the maximum tensile stress is within this range, fluidity among the toner particles is sufficiently ensured and images can be stably output even for enduring prolonged use.

It is desirable that the toner has a total energy (TE) amount of 90 mJ or more to 140 mJ or less at a stirring rate of 10 mm/s measured by a powder fluidity measurement apparatus. This TE is an index indicating how easily the toner can leave a consolidated state. If the TE is 90 mJ or more to 140 mJ or less, fusing of the toner to the surrounding parts, such as the developing sleeve, does not easily occur.

It is desirable that the toner according to the present invention has a volumetric specific heat of 3,800 $kJ/(m^3 \cdot {}^\circ C.)$ or more to 4,100 $kJ/(m^3 \cdot {}^\circ C.)$ or less. It is desirable that the volumetric specific heat of the toner, including the external additive, is within this range because low-temperature fixability can be exhibited while suppressing problems such as discharged sheets sticking together, parts fusing, and hot offset.

Next, the structure of the organic-inorganic composite fine particles will be described.

Examples of the resin component forming the organic particles of the organic-inorganic composite fine particles according to the present invention that may be used include monomers of styrene and substituents thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a polyacrylate resin, a polyolefin resin such as polyethylene, polypropylene, or polyacrylonitrile, polyvinyl acetate, polyvinyl butyral, polyvinyl chloride, polyvinyl carbazole, a polyvinyl ether and a polyvinyl ketone, a polyvinyl chloride-vinyl acetate copolymer, a fluorine resin such as polytetrafluoroethylene, polyvinyl fluoride, polyvinylidene fluoride, polychlorotrifluoroethylene and the like. These can be used alone or in combination of a plurality of resin components thereof.

Examples of the inorganic fine particles forming the organic-inorganic composite fine particles according to the present invention include fine particles of silica, alumina, titania, zinc oxide, strontium titanate, cerium oxide, calcium carbonate and the like. Especially desirable as the inorganic fine particles are silica fine particles, because such particles allow excellent charging properties to be obtained more easily. The silica fine particles may be fine particles obtained by a dry method such as fumed silica, or fine particles obtained by a wet method such as sol-gel silica.

From the perspectives of production stability and particle diameter distribution control, the content ratio of the inorganic fine particles in the organic-inorganic composite fine particles may be 30% by mass or more to 80% by mass or less based on the organic-inorganic composite fine particles.

The number average particle diameter of the inorganic fine particles may be 10 nm or more to 100 nm or less. If the particle diameter is within this range, concavities and convexities that are appropriate for the organic-inorganic composite fine particles can be formed, and detachment from the organic-inorganic composite fine particles can be suppressed.

The surface of the organic-inorganic composite fine particles may be treated with an organic silicon compound or a silicone oil. Treating with an organic silicon compound or a silicone oil increases hydrophobicity, so that it tends to be easier to obtain stable developing properties.

The surface treatment may be performed by treating the organic-inorganic composite fine particles, or by combining inorganic fine particles that have been subjected to the surface treatment with the resin.

The surface treatment may be a chemical treatment carried out with an organic silicon compound. Examples of the organic silicon compound may include the following.

Hexamethyldisilazane, methyl trimethoxysilane, octyl trimethoxysilane, isobutyl trimethoxysilane, trimethylsilane, trimethylchlorosilane, trimethylethoxysilane, dimethyl dichlorosilane, methyl trichlorosilane, allyl dimethyl dichlorosilane, allyl phenylalanine dichlorobenzene silane, benzyl dimethyl dichlorosilane, bromomethyl dimethyl chlorosilane, α-chloroethyl trichlorosilane, β-chloroethyl trichlorosilane, chloromethyl dimethyl chlorosilane, triorganosilyl mercaptan, trimethylsilyl mercaptan, triorganosilyl acrylate, vinyl dimethyl acetoxysilane, dimethyl silane, dimethyl dimethoxy silane, diphenyldiethoxysilane, 1-hexamethyldisiloxane, 1,3-divinyltetramethyldisiloxane, 1,3-diphenyltetramethyldisiloxane, and dimethylpolysiloxanes having 2 to 12 siloxane units per molecule and having 1 hydroxyl group bound to the Si in the unit positioned at the end. These can be used alone or in combination of two or more organic silicon compounds.

The organic silicon compound may also be a silicone oil. Further, the treatment may be performed using both an above-described compound and a silicone oil.

As the silicone oil, dimethyl silicone oil, methylphenyl silicone oil, α-methyl styrene-modified silicone oil, chlorophenyl silicone oil, and fluorine-modified silicone oil are desirable. Among these, a silicone oil with a viscosity of 30 $mm^2/s$ or more to 100 $mm^2/s$ or less at 25° C. is desirable.

Examples of the method for performing the silicone oil treatment include a method of directly mixing silica fine particles treated with a silane coupling agent with the silicone oil using a mixing machine like a Henschel™ mixer, and a method of spraying the silicone oil on the silica fine particles that will serve as a base. Alternatively, a more desirable method is to dissolve or disperse the silicone oil in an appropriate solvent, then add and mix the silica fine particles and remove the solvent.

The organic-inorganic composite fine particles according to the present invention can be produced based on a method described in WO2013/063291. Examples of other methods include: i) producing by driving the inorganic fine particles later into the organic particles; and (ii) dispersing the resin dissolved in a solvent in a dispersion medium in which the inorganic fine particles are dispersed to form particles, then removing the solvent to produce the organic-inorganic composite fine particles.

If producing the organic-inorganic composite fine particles by driving the inorganic fine particles later into the organic particles, the organic particles are first formed. Examples of the method for forming the organic particles may include freeze-crushing the resin to form fine particles, emulsifying/suspending the dissolved resin in a solution to obtain fine particles, and polymerizing a monomer of the resin component by emulsification polymerization or suspension polymerization to obtain resin particles.

Examples of apparatuses that can be used to drive the inorganic fine particles into the organic fine particles include a Hybridizer (manufactured by Nara Machinery Co., Ltd.), a Nobilta (manufactured by Hosokawa Micron Corporation), a Mechanofusion system (manufactured by Hosokawa Micron Corporation), a High Flex Gral (manufactured by Earth Technica Co., Ltd.) and the like.

The structure of the toner according to the present invention will be illustrated below.

First, the binder resin used in the toner base particles according to the present invention will be described.

Examples of the binder resin include a polyester resin, a vinyl resin, an epoxy resin, and a polyurethane resin. It is especially desirable for the binder resin to contain a polyester resin that has excellent fixability.

Examples of the alcohol component and the acid component that can be used when producing the polyester resin include the following.

As a dihydric alcohol component, it is desirable to include an aliphatic diol chain. Examples of the aliphatic diol may include ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol. If an aliphatic diol chain is contained, there may be a crystal site in the polyester molecule where the molecules are aligned, so that the mixing with a charge control agent having a crystal structure improves. This can hinder the charge control agent from melding easily with the toner or bleeding onto the toner surface, so that the advantageous effects of the present invention can be obtained more easily. The aliphatic diol chain content may 50% or more of the total alcohol component.

Examples of an aromatic diol include a bisphenol, and derivatives thereof, represented by the following formula [2], and a diol represented by the following formula [3].

[Formula 1]

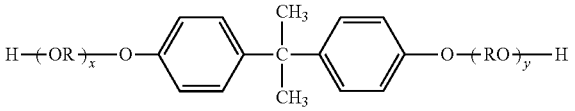

(wherein R represents ethylene or propylene, x and y each denote an integer of 1 or more, and the mean value of x+y is 2 to 10)

[Formula 2]

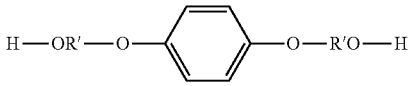

(wherein R' represents

[Formula 3]

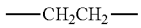

[Formula 4]

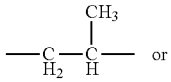

or

[Formula 5]

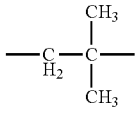

Examples of the divalent acid component include dicarboxylic acids or derivatives thereof, such as a benzene dicarboxylic acid such as phthalic acid, terephthalic acid, isophthalic acid, and phthalic anhydride, or their anhydrides and lower alkyl esters; an alkyl dicarboxylic acid such as succinic acid, adipic acid, sebacic acid, and azelaic acid, or their anhydrides and lower alkyl esters; an alkyl succinic acid or alkenyl succinic acid such as n-dodecenylsuccinic acid and n-dodecylsuccinic acid, or their anhydrides and lower alkyl esters; and an unsaturated dicarboxylic acid such as fumaric acid, maleic acid, citraconic acid, and itaconic acid, or their anhydrides and lower alkyl esters.

In the present invention, the binder resin is a polyester obtained by condensation polymerization of a carboxylic acid component containing 90 mol % or more of an aromatic carboxylic acid compound and the alcohol component. It is desirable that 80 mol % or more of the aromatic carboxylic acid compound is terephthalic acid and/or isophthalic acid.

Further, to achieve more uniform dispersibility of the internal additives, such as a magnetic iron oxide and wax, a trihydric or higher alcohol component and a trivalent or higher acid component that act as a crosslinking component may be used either alone or in combination.

Examples of a trihydric or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of a trivalent or higher polyvalent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxylic-2-methyl-2-methylenecarboxypropane, tetra(methylenecarboxyl) methane, 1,2,7,8-octanetetracarboxylic acid, an Empol trimer acid, and an anhydride of these compounds.

The alcohol component may be 40 mol % or more to 60 mol % or less, and desirably 45 mol % or more to 55 mol % or less, based on the total of the acid component and the alcohol component.

The above-described polyester resin may generally be obtained by commonly known condensation polymerization.

On the other hand, examples of the vinyl monomer used to produce the vinyl resin may include the following.

Styrene; styrene derivatives, such as o-methyl styrene, m-methylstyrene, p-methylstyrene, p-methoxystyrene, p-phenylstyrene, p-chlorostyrene, 3,4-di-chlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins, such as ethylene, propylene, butylene, and isobutylene; unsaturated polyenes, such as butadiene and isoprene; vinyl halides, such as vinyl chloride, vinylidene chloride, vinyl bromide, and vinyl fluoride; vinyl esters, such as vinyl acetate, vinyl propionate, and vinyl benzoate; α-methylene aliphatic monocarboxylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic esters, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinyl pyrrole, N-vinyl carbazole, N-vinyl indole, and N-vinylpyrrolidone; a vinylnaphthalene; and acrylic acids or methacrylic acid derivatives, such as acrylonitrile, methacrylonitrile, and acrylamide.

Further examples include unsaturated dibasic acids, such as maleic acid, citraconic acid, itaconic acid, alkenyl succinic acid, fumaric acid, and mesaconic acid; unsaturated dibasic acid anhydrides, such as maleic anhydride, citraconic anhydride, itaconic anhydride, and alkenyl succinic anhydride; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic acid esters, such as dimethyl maleate and dimethyl fumarate; α,β-unsaturated acids, such as acrylic acid, methacrylic acid, crotonic acid, and cinnamic acid; anhydrides of α,β-unsaturated acids, such as crotonic anhydride and cinnamic anhydride; anhydrides of the above-mentioned α,β-unsaturated acids and lower aliphatic acids; and monomers having a carboxyl group, such as alkenylmalonic acid, alkenylglutaric acid, alkenyladipic acid, and acid anhydrides thereof and monoesters thereof.

Still further examples include acrylate esters or methacrylate esters, such as 2-hydroxyethyl acrylate, 2-hydroxyethyl methacrylate, and 2-hydroxypropyl methacrylate; and monomers having a hydroxyl group, such as 4-(1-hydroxy-1-methylbutyl)styrene and 4-(1-hydroxy-1-methylhexyl) styrene.

In the toner according to the present invention, the vinyl resin of the binder resin may have a crosslinked structure that is crosslinked by a crosslinking agent having two or more vinyl groups.

Examples of the crosslinking agent used in this case include, as an aromatic divinyl compound, divinylbenzene and divinylnaphthalene; as a diacrylate compound bound by an alkyl chain, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds in which the acrylate is substituted with a methacrylate; as a diacrylate compound bound by an alkyl chain containing an ether bond, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds in which the acrylate is substituted with a methacrylate; as a diacrylate compound bound by a chain including an aromatic group and an ether bond, polyoxylethylene (2)-2,2-bis(4-hydroxyphenyl)propane diacrylate, polyoxyethylene (4)-2,2-bis(4-hydroxyphenyl)propane diacrylate, and the above compounds in which the acrylate is substituted with a methacrylate; and as a polyester-type diacrylate compound, the product MANDA (tradename, manufactured by Nippon Kayaku Co., Ltd.).

Further examples of a polyfunctional crosslinking agent include pentaerythritol triacrylate, trimethylolethane triacrylate, trimethylolpropane triacrylate, tetramethylolmethane tetraacrylate, oligoester acrylate, and the above compounds in which the acrylate is substituted with a methacrylate; and triallyl cyanurate and triallyl trimellitate.

These crosslinking agents can be used in an amount of desirably 0.01 parts by mass or more to 10 parts by mass or less, and more desirably 0.03 parts by mass or more to 5 parts by mass or less, based on 100 parts by mass of the other monomer components.

Among these crosslinking agents, it is desirable to use an aromatic divinyl compound (especially divinylbenzene) or a diacrylate compound bound by a chain including an aromatic group and an ether bond.

Further, examples of a polymerization initiator used when producing the vinyl include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, and 2,2'-azobis(2-methylpropane); ketone peroxides such as methyl ethyl ketone peroxide, acetylacetone peroxide, and cyclohexanone peroxide; and 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

From the perspective of storage stability, the above binder resin may have a glass transition point (Tg) of 45° C. or more to 70° C. or less, and desirably 50° C. or more to 70° C. or less.

The toner according to the present invention contains a magnetic material. This magnetic material usually also acts as a coloring agent.

In the present invention, examples of the magnetic material included in the magnetic toner include iron oxides such as magnetite, hematite, and ferrite, metals such as iron, cobalt, and nickel, or an alloy of these metals with aluminum, cobalt, copper, lead, magnesium, tin, zinc, antimony, bismuth, calcium, manganese, titanium, tungsten, and vanadium, and mixtures thereof.

The number average particle diameter of these magnetic materials is 0.05 μm or more to 2.0 μm or less, and desirably 0.10 μm or more to 0.50 μm or less. The content of the magnetic materials in the toner is, based on 100 parts by mass of the binder resin, desirably 30 parts by mass or more to 120 parts by mass or less, and especially desirably is 40 parts by mass or more to 110 parts by mass or less, based on 100 parts by mass of the binder resin.

The toner according to the present invention may also contain a wax.

Waxes that can be used in the present invention include aliphatic hydrocarbon waxes, such as low-molecular-weight polyethylene, low-molecular-weight polypropylene, a polyolefin copolymer, a polyolefin wax, a microcrystalline wax, a paraffin wax, and a Fischer-Tropsch wax; oxides of an aliphatic hydrocarbon wax, or a block copolymer thereof, such as oxidized polyethylene wax; vegetable waxes, such as candelilla wax, carnauba wax, Japan wax, and jojoba wax; animal waxes, such as beeswax, lanolin, spermaceti; mineral waxes, such as ozokerite, ceresin, and petrolatum; waxes mainly formed from an aliphatic ester, such as montanate wax and castor wax; and waxes obtained by partially or wholly deoxidizing an aliphatic ester, such as deoxidized carnauba wax. Further examples include saturated straight-chain fatty acids, such as palmitic acid, stearic acid and montanic acid, or a long-chain alkyl carboxylic acid further having a long-chain alkyl group; unsaturated fatty acids, such as brassidic acid, eleostearic acid, and parinaric acid; saturated alcohols, such as stearyl alcohol, eicosilyl alcohol, behenyl alcohol, carnaubyl alcohol, ceryl alcohol, and melissyl alcohol, or an alkyl alcohol further having a long-chain alkyl group; polyhydric alcohols, such as sorbitol; aliphatic amides, such as linoleic acid amide, oleic acid amide and lauric acid amide; saturated fatty acid bisamides, such as methylenebisstearic acid amide, ethylenebiscapric acid amide, ethylenebislauric acid amide, and hexamethylenebisstearic acid amide; unsaturated fatty acid amides, such as ethylenebisoleic acid amide, hexamethylenebisoleic acid amide, N,N'-dioleyl adipic acid amide, and N,N'-dioleyl sebacic acid amide; aromatic bisamides, such as m-xylenebisstearic acid amide, and N,N'-distearyl isophthalic acid amide; fatty acid metal salts, such as calcium stearate, calcium laurate, zinc stearate, and magnesium stearate (generally known as metal soaps); waxes obtained by grafting vinyl monomers, such as styrene, and acrylic acid to aliphatic hydrocarbon waxes; partially esterified products of fatty acid, and polyhydric alcohols, such as behenic acid monoglyceride; and hydroxyl group-containing methyl ester compounds obtained by hydrogenating vegetable oils and fats.

Further, as these waxes, it is desirable to use a wax whose molecular weight distribution has been sharpened by a press sweating method, a solvent method, a recrystallization method, a vacuum distillation method, a supercritical gas extraction method, or a melt-crystallization method. In addition, it is also desirable to use a wax from which low-molecular-weight solid aliphatic acids, low-molecular weight solid alcohols, or low-molecular weight solid compounds and other impurities have been removed.

Specific examples of waxes that can be used as a mold release agent include Viscol (registered trademark) 330-P, 550-P, 660-P, and TS-200 (Sanyo Chemical Industries, Ltd.), Hi-Wax 400P, 200P, 100P, 410P, 420P, 320P, 220P, 210P, and 110P (Mitsui Chemicals, Inc.), Sasol H1, H2, C80, C105, and C77 (Schumann Sasol Ltd.), HNP-1, HNP-3, HNP-9, HNP-10, HNP-11, and HNP-12 (Nippon Seiro Co., Ltd.), Unilin (registered trademark) 350, 425, 550, and 700, Unicid (registered trademark) 350, 425, 550, and 700 (Toyo Petrolite Co., Ltd.), Japan wax, beeswax, rice wax, candelilla wax, and carnauba wax (available from CERARICA NODA Co., Ltd.).

The toner according to the present invention may also contain a crystalline resin.

An example of the crystalline resin is a crystalline polyester. As the crystalline polyester, it is desirable to use at least an aliphatic diol having 4 or more to 20 or less carbon atoms and a polyvalent carboxylic acid as the starting materials.

Further, it is desirable that the aliphatic diol is linear. If the aliphatic diol is linear, resin crystallinity tends to increase.

Examples of aliphatic diols that can be used in the present invention include, but are not limited to, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol diol, 1,14-tetradecane diol, 1,18-octadecanediol, and 1,20-eicosanediol. These diols may be used mixed together.

Further, an aliphatic diol having a double bond may be used. Examples of such an aliphatic diol having a double bond include 2-butene-1,4-diol, 3-hexene-1,6-diol, and 4-octene-1,8-diol.

Next, the acid component used in the preparation of the crystalline polyester will be described. The acid component used in the preparation of the crystalline polyester is desirably a polyvalent carboxylic acid. As the polyvalent carboxylic acid, an aliphatic dicarboxylic acid and an aromatic dicarboxylic acid may be used. Especially, the aliphatic dicarboxylic acid is desirable. From the perspective of crystallinity, a linear carboxylic acid is especially desirable.

Examples of the aliphatic carboxylic acid include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecandicarboxylic acid, and 1,18-octadecanedicarboxylic acid. Alternatively, a lower alkyl ester or an acid anhydride of these may be used. Among these examples, sebacic acid, adipic acid, 1,10-decanedicarboxylic acid, or a lower alkyl ester or an acid anhydride thereof, are desirable. In some cases these diols may be used mixed together.

Examples of the aromatic carboxylic acid include terephthalic acid, isophthalic acid, 2,6-naphthalenedicarboxylic acid, and 4,4'-biphenyldicarboxylic acid. Among these, from the perspective of availability and ease of forming a low-melting point polymer, terephthalic acid is desirable.

A carboxylic acid having a double bond may also be used. Examples of the carboxylic acid include, but are not limited to, fumaric acid, maleic acid, 3-hexenedioic acid, and 3-octenedioic acid. Further, a lower alkyl ester or an acid anhydride of these may be used. Among these examples, from a cost perspective, fumaric acid and maleic acid are desirable.

The method for producing the above crystalline polyester is not especially limited. For example, the crystalline polyester can be produced by a common polyester polymerization method in which an acid component and an alcohol component are reacted. The method may be carried out by direct polymerization or by a transesterification process depending on the monomer type.

Production of the above crystalline polyester can be performed between a polymerization temperature of 180° C. or more to 230° C. or less. The reaction can be carried out by optionally reducing the pressure in the reaction system, while removing the water and alcohols produced during condensation. If the monomers do not dissolve or are incompatible at the reaction temperature, a high-boiling point solvent may be added as a solubilizing agent to dissolve the monomers. The condensation polymerization reaction is performed while removing this solubilizing agent by distillation. If a monomer having poor compatibility is present in the copolymerization reaction, the monomer having poor compatibility and the acid or alcohol to be used in the polycondensation with that monomer may be condensed in advance, and then subjected to polycondensation with the main component.

Examples of catalysts that can be used in production of the above crystalline polyester include, but are not limited to, titanium catalysts, such as titanium tetra-ethoxide, titanium tetra-propoxide, titanium tetraisopropoxide, and titanium tetrabutoxide, and tin catalysts, such as dibutyltin dichloride, dibutyltin oxide, and diphenyltin oxide.

In the toner according to the present invention, a charge control agent may be used to stabilize the charging properties of the toner. As the charge control agent, organic metal complexes and chelate compounds whose center metal that easily interacts with the acid group or the hydroxyl group at the end of the binder resin used in the present invention are effective. Examples include monoazo metal complexes; acetylacetone metal complexes; and a metal complex or a metal salt of an aromatic hydroxy-carboxylic acid or an aromatic dicarboxylic acid.

Specific examples that can be used include Spilon Black TRH, T-77, and T-95 (Hodogaya Chemical Co., Ltd.), and BONTRON (registered trademark) S-34, S-44, S-54, E-84, E-88, and E-89 (Orient Chemical Industries Co., Ltd.). Further, a charge control resin can also be used together with the above charge control agents.

The method for producing the toner base particles according to the present invention is not especially limited, and may, for example, be performed using a known production method such as a pulverizing method, a suspension polymerization method, a dissolution suspension method, an emulsion aggregation method, a dispersion polymerization method and the like.

In the pulverizing method, the toner base particles according to the present invention can be obtained by i) thoroughly mixing the binder resin, the magnetic particles, and optionally the wax and other additives with a mixing machine, such as a Henschel™ mixer or a ball mill, ii) melt-kneading the obtained mixture with a hot kneading machine, such as a twin-screw kneading extruder, a heated roll, a kneader, or an extruder, iii) cooling to solidify, then pulverizing, and iv) classifying.

Further, to control the shape and surface properties of the toner base particles, it is desirable to have a surface treatment step after the pulverizing or classification.

Examples of the mixing machine include a Henschel™ Mixer (manufactured by Mitsui Mining & Smelting Co., Ltd.); a Super Mixer (manufactured by Kawata Mfg. Co., Ltd.); a Ribocone (manufactured by Okawara Mfg., Co., Ltd.); a Nauta Mixer, a Turbulizer, and a Cyclomix Mixer (all manufactured by Hosokawa Micron Corporation); a Spiralpin Mixer (manufactured by Pacific Machinery & Engineering Co., Ltd.); and a Lodige Mixer (manufactured by Matsubo Corporation).

Examples of the kneading machine include a KRC Kneader (manufactured by Kurimoto, Ltd.); a Buss Co-kneader (manufactured by Buss AG); a TEM-type Extruder (manufactured by Toshiba Machine Co., Ltd.); a TEX Twin-screw Kneading Machine (manufactured by The Japan Steel Works, Ltd.); a PCM Kneading Machine (manufactured by Ikegai Corp.); a Three Roll Mill, a Mixing Roll Mill, and a Kneader (all manufactured by Inoue Mfg., Inc.); a Kneadex (manufactured by Mitsui Mining & Smelting Co., Ltd.); an MS-type Pressure Kneader and a Kneader-Ruder (both manufactured by Moriyama Company Ltd.); and a Banbury Mixer (manufactured by Kobe Steel, Ltd.).

Examples of the pulverizing machine include a Counter Jet Mill, a Micron Jet, and an Inomizer (all manufactured by Hosokawa Micron Corporation); an IDS-type Mill and a PJM Jet Pulverizer (both manufactured by Nippon Pneumatic Mfg. Co., Ltd.); a Cross Jet Mill (manufactured by Kurimoto, Ltd.); an Ulmax (manufactured by Nisso Engineering Co., Ltd.); an SK Jet-O-Mill (manufactured by Seisin Enterprise Co., Ltd.); a Cliptron (manufactured by Kawasaki Heavy Industries, Ltd.); a Turbo Mill (manufactured by Turbo Kogyo Co., Ltd.); and a Super Rotor (manufactured by Nisshin Engineering Inc.).

Examples of the classifying machine include a Classiel, a Micron Classifier and a Spedic Classifier (all manufactured by Seisin Enterprises Co., Ltd.); a Turbo Classifier (manufactured by Nisshin Engineering Inc.); a Micron Separator, a Turboplex (ATP), and a TSP Separator (all manufactured by Hosokawa Micron Corporation); an Elbow-Jet (manufactured by Nittetsu Mining Co., Ltd.); a Dispersion Separator (manufactured by Nippon Pneumatic Mfg. Co., Ltd.); and a YM Microcut (manufactured by Yasukawa Shoji K.K.).

Examples of the surface modifying apparatus include a Faculty (manufactured by Hosokawa Micron Corporation), a Mechanofusion (manufactured by Hosokawa Micron Corporation), a Nobilta (manufactured by Hosokawa Micron Corporation), a Hybridizer (manufactured by Nara Machinery Co., Ltd.), an Inomizer (manufactured by Hosokawa Micron Corporation), and a Theta Composer (manufactured by Tokuju Corporation).

Examples of the sieving device used for sieving coarse particles include an Ultra Sonic (manufactured by Koei Sangyo Co., Ltd.); a Resona Sieve and a Gyro Sifter (both manufactured by Tokuju Corporation); a Vibrasonic System (manufactured by Dalton Co., Ltd.); a Soniclean (manufactured by Shinto Kogyo Kabushiki Kaisha); a Turbo Screener (manufactured by Turbo Kogyo Co., Ltd.); a Micro Sifter (manufactured by Makino Mfg. Co., Ltd.); and a circular vibrating sieve.

Production of the toner by a suspension polymerization method will now be described. A suspension polymerization method is desirable, because toner base particles obtained by suspension polymerization generally have a spherical shape, which means that their charge amount distribution is also comparatively uniform.

In the case of producing the toner base particles by suspension polymerization, the particles can be produced based on the following steps, for example. i) The polymerizable monomer, the magnetic material, the polymerization initiator, and optionally a crosslinking agent, a charge control agent, and other additives, are uniformly dissolved or dispersed to obtain a polymerizable monomer composition. ii) The polymerizable monomer composition is dispersed in a dispersion solvent (e.g., an aqueous phase) containing a dispersion stabilizer using a suitable stirring device to produce granules. iii) A polymerization reaction is performed. iv) The polymer particles are washed, then filtered and dried to obtain toner base particles. The polymerization initiator may be added at the same time the other additives are added into the polymerizable monomer composition like in the above, or may be admixed immediately before producing the granules. Further, a polymerization initiator dissolved in the polymerizable monomer composition or a solvent may also be added immediately after producing the granules, before the polymerization reaction starts.

Examples of the polymerizable monomer used in the suspension polymerization may include the monomers mentioned as examples of the vinyl monomer used in the production of the vinyl resin. Among those, from the perspectives of developing properties and durability, it is desirable to use a mixture of styrene and an acrylate or a methacrylate.

Although the polymerization initiators mentioned as examples of the polymerization initiator used in the production of the vinyl resin may be used as the polymerization initiator to be used in the suspension polymerization, it is desirable that the polymerization initiator has a half-life of 0.5 hours or more to 30.0 hours or less in the polymerization reaction. Further, the added amount of the polymerization initiator is desirably 0.5 parts by mass or more to 20.0 parts by mass or less based on 100 parts by mass of the polymerizable monomer.

As the crosslinking agent used in the suspension polymerization, the crosslinking agents mentioned as examples of the crosslinking agent used in the production of the vinyl resin can be used. A desirable added amount of the crosslinking agent is 0.01 parts by mass or more to 10.0 parts by mass or less based on 100 parts by mass of the polymerizable monomer.

A dispersion device, such as a homogenizer, a ball mill, or an ultrasound disperser, can be used to produce the granules by dispersing the polymerizable monomer composition in the dispersion medium containing a dispersion stabilizer. At this stage, the obtained toner base particles have a sharper particle diameter distribution if the size of the toner base particles is achieved in one go by using a dispersion device such as a high-speed stirrer or an ultrasonic disperser. After granulation, it is sufficient to perform stirring at a level that maintains the particle state and prevents floating/sedimentation of the particles using an ordinary stirring device.

As the dispersion stabilizer used in the suspension polymerization, known surfactants, organic dispersing agents, and inorganic dispersing agents can be used. Among these, it is desirable to use an inorganic dispersing agent because stability with respect to the reaction temperature is high and washing is easy. Examples of such an inorganic dispersing agent may include a polyvalent metal salt of phosphoric acid, such as tricalcium phosphate, magnesium phosphate, aluminum phosphate, zinc phosphate, and hydroxyapatite, a carbonate such as calcium carbonate and magnesium carbonate, an inorganic salt such as calcium metasilicate, calcium sulfate, and barium sulfate, and an inorganic compound such as calcium hydroxide, magnesium hydroxide, and aluminum hydroxide.

It is desirable to use these inorganic dispersing agents in an amount of from 0.20 parts by mass or more to 20.00 parts by mass or less based on 100 parts by mass of the polymerizable monomer. In addition, a single kind of dispersion stabilizer may be used or a plurality of kinds may be used in combination. A surfactant may also be co-used in an amount of $1.0\times10^{-4}$ parts by mass or more to $1.0\times10^{-1}$ parts by mass or less based on 100 mass parts of the polymerizable monomer.

In the step of polymerizing the above polymerizable monomer, the polymerization temperature is set to a temperature of 40° C. or more, and generally 50° C. or more to 90° C. or less.

It is desirable that the toner according to the present invention includes an external agent other than the organic-inorganic composite fine particles. Especially, to improve the fluidity and charging properties of the toner, it is desirable to add as another external agent a fluidity improver that has a small particle size (a number average particle diameter of primary particles of about 5 to 30 nm).

Examples of the fluidity improver may include fluororesin powders, such a vinylidene fluoride fine powder and a polytetrafluoroethylene fine powder; fine silica powders, such as wet silica and dry silica, a titanium oxide fine powder, and an alumina fine powder; treated silica obtained by subjecting the above to a surface treatment with a silane compound, a titanium coupling agent, or silicone oil; oxides, such as zinc oxide and tin oxide; composite oxides, such as strontium titanate, barium titanate, calcium titanate, strontium zirconate, and calcium zirconate; and carbonate compounds, such as calcium carbonate and magnesium carbonate.

Examples of desirable fluidity improves include fine powders, referred to as dry silica or fumed silica, that are produced by vapor-phase oxidation of a silicon halide. For example, a basic reaction formula that utilizes an oxidative pyrolysis reaction in an oxyhydrogen flame of silicon tetrachloride gas, for example, is as follows.

$$SiCl_4+2H_2+O_2\rightarrow SiO_2+4HCl$$

In this production step, a composite fine powder of silica and other metal oxides can be obtained by using another metal halide, such as aluminum chloride or titanium chloride, with the silicon halide. Here, the term "silica" includes such composite fine powders.

Examples of commercially-available silica fine powders produced by vapor-phase oxidation of a silicon halide compound include AEROSiL (NIPPON AEROSIL Co., Ltd.) 130, 200, 300, 380, TT600, MOX170, MOX80, and C0K84, Ca—O—SiL (Cabot Co.) M-5, MS-7, MS-75, HS-5, and EH-5, Wacker HDK N 20 (Wacker-Chemie GmbH), V15, N20E, T30, and T40, D-CFine Silica (Dow Corning Co.); and Fransol (Francil).

Further, it is more desirable to employ as the fluidity improver to be used in the present invention a treated silica fine powder obtained by subjecting a silica fine powder produced by vapor-phase oxidation of a silicon halide compound to a hydrophobic treatment. The hydrophobic treatment can be carried out using the same method as the surface treatment of the organic-inorganic composite fine particles or the inorganic fine particles used for the organic-inorganic composite fine particles.

It is desirable that the fluidity improver has a specific surface area based on nitrogen adsorption measured by a BET method of 30 $m^2/g$ or more to 300 $m^2/g$ or less.

It is desirable that the added amount of the fluidity improver is 0.01 parts by mass or more to 8 parts by mass or less, and more desirably 0.1 parts by mass or more to 4 parts by mass or less, based on 100 parts by mass of the toner base particles.

It is especially desirable that the mass ratio of the organic-inorganic composite fine particles and the fluidity improver (fluidity improver/organic-inorganic composite fine particles) is 0.1 or more to 2.2 or less. The mass ratio is desirably within this range because the initial fluidity and charging properties of the toner are better, so that a high image density can be obtained from the start, while suppressing problems such as fixing interference caused by the addition of a large amount of external additive particles. Further, because of the presence of the highly fluid external additive having a small particle size, the state of the organic-inorganic composite fine particles on the toner surface is more uniform. Consequently, problems such as deterioration in the fluidity of the toner and welding can be better suppressed. If the above mass ratio is 0.2 or more to 0.8 or less, these effects are more pronounced.

Next, the methods for measuring the various properties according to the present invention will be described.

<Method for Measuring the Shape Factors SF-1 and SF-2 of the Organic-Inorganic Composite Fine Particles>

The shape factors SF-1 and SF-2 of the organic-inorganic composite fine particles were calculated in the following manner using the scanning electron microscope (SEM) "S-4800" (manufactured by Hitachi, Ltd.) by observing toner to which an external additive has been externally added.

The circumferential length and the surface area of 100 primary particles of the organic-inorganic composite fine particles were calculated using the image processing software "Image-Pro Plus 5.1J" (Media Cybernetics, Inc.) in a field of view magnified by a factor of 100,000 to 200,000.

SF-1 and SF-2 were calculated based on the following equation, and the average value thereof was taken as SF-1 and SF-2.

$$\text{SF-1}=(\text{Particle maximum length})^2/\text{particle surface area}\times\pi/4\times100$$

$$\text{SF-2}=(\text{Particle circumferential length})^2/\text{particle surface area}\times100/4\pi$$

<Method for Measuring the Number Average Particle Diameter of the External Additive>

Measurement of the number average particle diameter of primary particles of the organic-inorganic composite fine particles was performed using the scanning electron microscope (SEM) "S-4800" (trade name, manufactured by Hitachi, Ltd.). The number average particle diameter was determined by observing toner to which organic-inorganic composite fine particles had been externally added, and randomly measuring the long diameter of 100 primary particles of the external additive in a field of view magnified up to a maximum factor of 200,000. The observation magnification was appropriately adjusted based on the size of the organic-inorganic composite fine particles.

Further, the number average particle diameter of primary particles of the fluidity improver and the like can be similarly determined using the transmission electron microscope "H-800" (manufactured by Hitachi, Ltd.) by magnifying up to a maximum factor of 1,000,000. The observation magnification is appropriately adjusted based on the size of the external additive.

<Method for Measuring the Number of Added Parts of External Additive>

A few drops of toner and "Contaminon N" (a 10% by mass aqueous solution of a neutral detergent for washing precision measuring devices formed from a nonionic surfactant, an anionic surfactant, and an organic builder and having a pH of 7, manufactured by Wako Pure Chemical Industries, Ltd.) were added dropwise to ion-exchanged water. The resultant mixture was ultrasonically dispersed and then left to stand for 24 hours. The external additive can be isolated by collecting the supernatant and drying. If a plurality of external additives are added to the toner, measurement can be performed by separating the supernatant solutions by a centrifugal separation method to isolate them.

The number of added parts of each external additive was quantified by measuring the dried mass of the thus-isolated toner base particles and external additives.

<Method for Measuring Volumetric Specific Heat>

In the present invention, the specific heat (J/g·° C.) and the true density ($g/cm^3$) of a sample were individually determined, and the volumetric specific heat was calculated from those values.

Measurement of the specific heat was performed using the input-compensation type differential scanning calorimeter DSC8500 manufactured by TA Instruments under the Step Scan mode. An aluminum pan was used for the sample and an empty pan was used for a comparison. The sample was heated for 1 minute at 20° C., and then the temperature was increased to 100° C. at a rate of 10° C./min. The specific heat at the 80° C. point was calculated.

True density was measured with the dry-type automatic densitometer AccuPyc II 1330.

When measuring the volumetric specific heat of the toner base particles and the organic-inorganic composite fine particles, the toner base particles and the organic-inorganic composite fine particles were isolated from the toner as follows, for example. First, a few drops of toner and "Contaminon N" (a 10% by mass aqueous solution of a neutral detergent for washing precision measuring devices formed from a nonionic surfactant, an anionic surfactant, and an organic builder and having a pH of 7, manufactured by Wako Pure Chemical Industries, Ltd.) was added dropwise to ion-exchanged water. The resultant mixture was ultrasonically dispersed and then left to stand for 24 hours. The external additive can be isolated by collecting the supernatant and drying. If a plurality of external additives were added to the toner, isolation can be performed by separating the supernatant solutions by a centrifugal separation method.

<Method for Measuring Toner Adhesive Strength>

The toner adhesive strength was measured with the compression breaking strength/tensile fracture strength measurement apparatus Agrobot AGR-2 (manufactured by Hosokawa Micron Corporation). A fixed amount of powder was filled into the top and bottom halves of a cylindrical cell. After holding the powder at a predetermined pressure, the toner adhesive strength was determined by lifting the upper portion of the cell and measuring the maximum tensile stress ($g/cm^2$). The measurement conditions were as follows.

Ambient temperature: 25° C.
Humidity: 50%
Cell inner diameter: 25 mm
Cell height: 37.5 mm
Cell temperature: 25° C.
Spring wire diameter: 1.0 mm
Compression rate: 0.10 mm/sec
Compressive stress: 8 $kg/cm^2$
Tensile speed: 0.40 mm/sec
Tension sampling time: 25 sec <Method for Measuring the Weight Average Particle Diameter (D4) of the Toner Base Particles>

The weight average particle diameter (D4) of the toner base particles was measured using a precision granularity distribution measuring apparatus "Coulter Counter Multisizer 3" (registered trademark, manufactured by Beckman Coulter, Inc.) provided with a 100 μm aperture tube, which relies on a pore electrical resistance method. The setting of the measurement conditions and the analysis of the measurement data were performed using the dedicated software "Beckman Coulter Multisizer 3 Version 3.51" (by Beckman Coulter, Inc.) belonging to the apparatus. Measurement was performed with the number of effective measurement channels set to 25,000.

An electrolytic aqueous solution prepared by dissolving reagent grade sodium chloride in ion-exchanged water to a concentration of about 1 mass %, for example, "ISOTON II" (manufactured by Beckman Coulter, Inc.) can be used for the measurement.

The settings in the dedicated software were made as follows prior to measurement and analysis.

In the "screen to change the standard measurement method (SOM)" of the dedicated software, the total count number in the control mode was set to 50,000 particles, the number of measurements set to 1, and a value obtained by using "standard particles 10.0 μm" (manufactured by Beckman Coulter, Inc.) set as a Kd value. The threshold value and the noise level were automatically set by pressing the "threshold/noise level measurement" button. The current was set to 1600 μA, the gain set to 2, the electrolyte solution set to ISOTON II, and a check box for "flush aperture tube after measurement" was ticked.

In the "setting screen for conversion from pulse to particle size" of the dedicated software, the bin interval was set to a logarithmic particle size, the number of particle size bins was set to 256, and the particle size range was set from 2 μm to 60 μm.

The specific measurement method was as follows.

(1) About 200 ml of the electrolytic aqueous solution was charged into a 250-ml round-bottom glass beaker designed for the Multisizer 3. The beaker was set in a sample stand, and the electrolyte solution in the beaker stirred with a stirrer rod at 24 revolutions/sec in a counterclockwise direction. Then, dirt and bubbles in the aperture tube were removed by the "aperture flush" function of the dedicated software.

(2) About 30 ml of the electrolytic aqueous solution was charged into a 100-ml flat-bottom glass beaker. Then, about 0.3 ml of a diluted solution prepared by diluting "Contaminon N" (a 10 mass % aqueous solution having a pH of 7 of a neutral detergent for washing precision instruments, containing a nonionic surfactant, a anionic surfactant, and an organic builder, manufactured by Wako Pure Chemical Industries, Ltd.) about three times its mass with ion-exchanged water, was added as a dispersant to the beaker.

(3) An ultrasonic dispersing unit "Ultrasonic Dispersion System Tetra 150" (manufactured by Nikkaki Bios Co., Ltd.), which has two oscillators with an oscillation frequency of 50 kHz, phase shifted by 180° with respect to each other, was readied. About 3.3 L of ion-exchanged water was charged into the water tank of the ultrasonic dispersing unit, and about 2 ml of Contaminon N was then added to the water tank.

(4) The beaker in (2) was set in a beaker fixing hole of the ultrasonic dispersing unit, and the ultrasonic dispersing unit was operated. Then, the height position of the beaker was adjusted so that the resonance state of the liquid level of the electrolytic aqueous solution in the beaker was at a maximum.

(5) About 10 mg of toner was gradually added to, and dispersed in, the electrolytic aqueous solution in the beaker of (4) while the electrolytic aqueous solution was being irradiated with ultrasonic waves. The ultrasonic dispersion treatment was continued for an additional 60 seconds. The temperature of water in the water tank was appropriately adjusted to 10° C. or more to 40° C. or less for the ultrasonic dispersion.

(6) The electrolytic aqueous solution of (5) having the toner dispersed therein was added dropwise using a pipette into the round-bottom beaker of (1) placed in the sample stand, and the measurement concentration was adjusted to about 5%. Measurement was performed until 50,000 particles had been measured.

(7) The measurement data was analyzed with the dedicated software belonging to the apparatus to calculate the weight average particle diameter (D4). The weight average particle diameter (D4) is the "average diameter" on the "analysis/volume statistics (arithmetic average) screen" when the dedicated software is set to graph/vol %.

<Toner Average Circularity>

The average circularity of the toner was measured with a flow-type particle image analyzer "FPIA-3000" (manufactured by Sysmex Corporation) under the measurement and analysis conditions as at the time of calibration.

The specific measurement method was as follows. First, about 20 ml of ion-exchanged water from which solid impurities and the like had been removed beforehand was charged into a container made of glass. Then, about 0.2 ml of a diluted solution prepared by diluting "Contaminon N" (a 10 mass % aqueous solution of a neutral detergent for washing precision instruments having a pH of 7, containing a nonionic surfactant, an anionic surfactant, and an organic builder, manufactured by Wako Pure Chemical Industries, Ltd.) with about three times its mass of ion-exchanged water, was added as a dispersant to the container. Further, about 0.02 g of a measurement sample was added to the container, and the mixture was subjected to a dispersion treatment using an ultrasonic dispersing unit for 2 minutes to obtain a dispersion for measurement. The dispersion was appropriately cooled to a temperature from 10° C. to 40° C. A desktop ultrasonic cleaning and dispersing unit having an oscillation frequency of 50 kHz and an electrical output of 150 W (such as a "VS-150" (manufactured by Velvo-Clear)) was used as the ultrasonic dispersing unit. A predetermined amount of ion-exchanged water was charged into a water tank, and about 2 ml of Contaminon N was added to the water tank.

A flow-type particle image analyzer equipped with a "UPlanApro" (10× magnification, numerical aperture 0.40) as an objective lens was used in the measurement, and a particle sheath "PSE-900A" (manufactured by Sysmex Corporation) was used as the sheath liquid. The dispersion prepared according to the above procedure was introduced into the flow-type particle image analyzer, and the particle size of 3,000 toner particles was measured according to a total count mode in an HPF measurement mode. The average circularity of the toner was determined by setting the binarization threshold during particle analysis to 85% and limiting the analyzed particle size to particles a circle-equivalent diameter of 1.98 μm or more to less than 39.96 μm.

<Method for Measuring the Amount of Total Energy (TE)>

In this invention, the TE was measured using a powder flowability analyzer equipped with a rotary propeller-type blade (Powder Rheometer FT-4, manufactured by Freeman Technology Ltd.; abbreviated below as "FT-4").

Figure 1B:
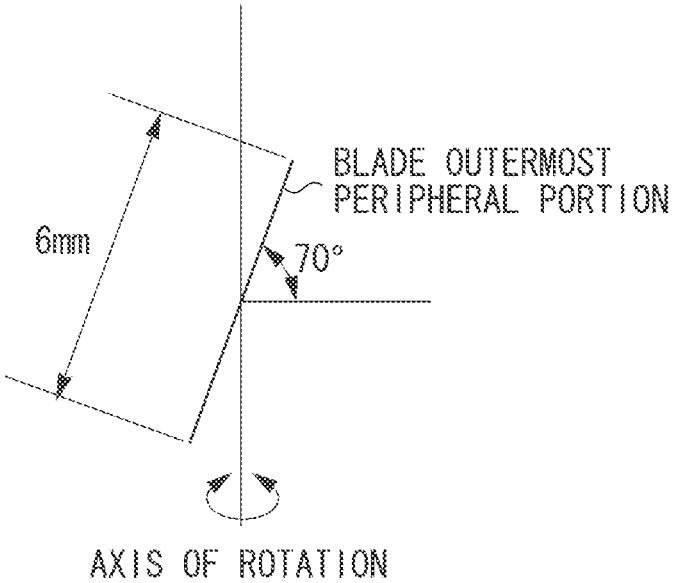

Specifically, measurement was carried out by performing the following operations. In all the operations, the used propeller blade was a 23.5 mm diameter blade for use in FT-4 measurement (see FIG. 1A). An axis of rotation exists in the normal direction at the center of the 23.5 mm×6.5 mm blade plate. The blade plate is smoothly twisted counter-clockwise to 70° at both outermost end portions thereof (the portions 12 mm from the axis of rotation), and 35° at portions 6 mm from the axis of rotation (see FIG. 1B). The blade material is SUS stainless steel).

The toner was placed for 3 days in a specialized vessel for use in FT-4 measurement (a 25 mm diameter, 25 mL volume split vessel (model No.: C4031); height from vessel bottom to split portion, about 51 mm; referred to below simply as the "vessel") and compacted under pressure to form a toner powder layer.

A piston for compacting tests (diameter, 24 mm; height, 20 mm; lined on the bottom with a mesh) was used instead of the propeller blade for compacting the toner.

(1) Toner Compacting Operation

First, 8 g of toner was placed in the above-described FT-4 measurement vessel. A compression piston for FT-4 measurement was attached, and compression at 5.8 kPa was carried out for 60 seconds. Eight grams of toner was again added and the compression operation was similarly carried out a total of three times, resulting in a total of 24 g of compacted toner within the dedicated vessel.

(2) Splitting Operation

The toner powder layer was scraped flat at the split portion of the special vessel for FT-4 measurement, and the toner at the top of the toner powder layer was removed, thereby forming toner powder layers each having the same volume (25 mL).

(3) Measurement Operation

The blade was rotated clockwise with respect to the surface of the toner powder layer (in the direction where blade rotation does not push into the toner powder layer) and at a blade peripheral velocity (peripheral velocity at outermost tip of the blade) of 10 mm/sec. The propeller-type blade was advanced into the toner powder layer at such a speed of entry in the vertical direction that the angle formed between the path traced by the outermost tip of the blade during movement and the powder layer surface (hereinafter referred to below as the "blade path angle") becomes 5 degrees, to a position 10 mm from the bottom of the toner powder layer.

In the above measurement operation, the sum of the rotational torque and perpendicular load obtained while advancing the blade from the top surface of the toner power layer to a position 10 mm from the bottom was taken as the TE.

Although the present invention will now be described in more detail with reference to the following examples and comparative examples, the present invention is not limited in any way to these. Further, unless stated otherwise, "parts" and "%" in the examples and comparative examples are all in terms of mass.

<Production Example of Hybrid Resin 1>

| | |
|---|---|
| Bisphenol A ethylene oxide adduct (average 2.2 mol added) | 100.0 mol parts |
| Terephthalic acid | 60.0 mol parts |
| Trimellitic acid anhydride | 20.0 mol parts |
| Acrylic acid | 10.0 mol parts |

A four-necked flask was charged to the flask with 60 parts by mass of the above monomer mixture for a polyester. A pressure-reducing device, a moisture separator, a nitrogen gas introduction device, a temperature measurement device, and a stirring device were attached to the flask, and the mixture was stirred under a nitrogen atmosphere at 160° C. A mixture of 40 parts by mass of a styrene monomer and 1.9 parts by mass of benzoyl peroxide as a polymerization initiator was added dropwise into the flask from a dropping funnel for 4 hours. Then, after reacting for 5 hours at 160° C., the temperature was increased to 230° C. and 0.2% by mass of dibutyltin oxide was added.

After the reaction, the product was removed from the vessel, cooled, and pulverized to obtain hybrid resin 1. Hybrid resin 1 had a Tg of 61° C. and a softening point of 130° C.

<Production Example of Polyester Resin 1>

| | |
|---|---|
| Bisphenol A propylene oxide adduct (average 2.2 mol added) | 60.0 mol parts |
| Bisphenol A ethylene oxide adduct (average 2.2 mol added) | 40.0 mol parts |
| Terephthalic acid | 77.0 mol parts |

A 5-L autoclave was charged with the above polyester monomer mixture and 0.2% by mass of dibutyltin oxide based on the monomer total amount. A reflux condensor, a moisture separator, an $N_2$ gas introduction pipe, a thermometer, and a stirring device were attached, and a polymerization condensation reaction was carried out at 230° C. while introducing $N_2$ gas into the autoclave. The reaction time was adjusted to obtain a desired softening point. After the reaction finished, the product was removed from the vessel, cooled, and pulverized to obtain polyester resin 1. Polyester resin 1 had a Tg of 58.5° C. and a softening point of 90° C.

<Production Example of Crystalline Polyester Resin 1>

| | |
|---|---|
| 1,12-Dodecanediol | 100 mol parts |
| Sebacic acid | 100.0 mol parts |

A 10-L four-necked flask equipped with a nitrogen introduction pipe, a dewatering pipe, a stirring device, and a thermocouple was charged with the above starting materials and 0.2% by mass of dibutyltin oxide based on the monomer total amount. The resultant mixture was reacted for 4 hours at 180° C., and the temperature was then increased to 210° C. at 10° C. per hour. After holding for 8 hours at 210° C., the mixture was reacted for 1 hour at 8.3 kPa to obtain crystalline polyester resin 1. The obtained crystalline polyester resin 1 had melting point of 82.0° C.

<Production Example of Magnetic Toner Base Particles 1>

| | |
|---|---|
| Above hybrid resin 1 | 60 parts by mass |
| Above polyester resin 1 | 40 parts by mass |
| Above crystalline polyester resin 1 | 2.5 parts by mass |
| Magnetic iron oxide particles (number average particle diameter = 0.20 μm, Hc = 11.5 kA/m, σs = 88 $Am^2/kg$, σr = 14 $Am^2/kg$) | 60.0 parts by mass |
| Mold release agent (Fischer-Tropsch wax (manufactured by Sasol Ltd., C105, melting point 105° C.)) | 2.0 parts by mass |
| Charge control agent (T-77, manufactured by Hodogaya Chemical Co., Ltd.) | 2.0 parts by mass |

The above materials were pre-mixed with a Henschel™ mixer, and then melt-kneaded with a twin-screw kneading extruder.

The obtained kneaded product was cooled, coarsely pulverized with a hammer mill, and then pulverized with a mechanical pulverizer (T-250, manufactured by Turbo Corporation). The obtained finely pulverized powder was classified using a multistage classifier utilizing the Coanda effect to obtain negatively-charged starting material toner particles having a weight average particle diameter (D4) of 7.0 μm.

These starting material toner particles were classified and then treated by the surface modifying apparatus Faculty (manufactured by Hosokawa Micron Corporation). During this treatment, the rotational peripheral velocity of the dispersion rotor was set at 150 m/sec, the charged amount of pulverized fine powder was set at 7.6 kg per cycle, and the surface modifying time (=cycle time, time until the supply of the starting material finished until the discharge valve opened) was set at 82 seconds. Further, the temperature of the toner base particles at discharge was 44° C. Based on the above steps, magnetic toner base particles 1 were obtained.

The volumetric specific heat of the magnetic toner base particles) was 3,818 kJ/($m^3$·° C.), and the average circularity was 0.965.

<Production Example of Magnetic Toner Base Particles 2 to 11>

Magnetic toner base particles 2 to 11 were obtained in the same manner as magnetic toner base particles 1, except that the used resin and the amount of the magnetic material were changed as shown in Table 1. The properties of the obtained magnetic toner base particles 2 to 11 are shown in Table 1.

<Production Example of Magnetic Toner Base Particles 12>

Four hundred and fifty parts by mass of a 0.1 mol/L $Na_3PO_4$ aqueous solution was charged into 720 parts by mass of ion-exchanged water. The resultant mixture was heated to 60° C., and then charged with 67.7 parts by mass of a 1.1 mol/L $CaCl_2$ aqueous solution to obtain an aqueous medium including a dispersion stabilizer ($Ca_3(PO_4)_2$).

| | |
|---|---|
| Styrene | 74.00 parts by mass |
| n-Butyl acrylate | 26.00 parts by mass |
| Divinylbenzene | 0.52 parts by mass |
| Iron complex of a monoazo dye (T-77, manufactured by Hodogaya Chemical Co., Ltd.) | 1.00 parts by mass |
| Magnetic material hydrophobized with an n-hexyl trimethoxy silane coupling agent (volume average particle diameter = 0.21 μm) | 90.00 parts by mass |
| Non-crystalline polyester (saturated polyester resin obtained by a condensation reaction of an ethylene oxide adduct of bisphenol A and terephthalic acid, Mn = 5,000, acid value = 12 mgKOH/g, Tg = 68° C.) | 3.00 parts by mass |

A monomer composition was obtained by dispersing and mixing the above components with an attritor (Mitsui Mining & Smelting Co., Ltd.). The monomer composition was heated to 60° C. After mixing and dissolving 15.0 parts by mass of paraffin wax (endothermic peak top temperature: 77.2° C.) into the composition, 4.5 parts by mass of the polymerization initiator 2,2'-azobis(2,4-dimethylvaleronitrile) was dissolved.

The above monomer composition was charged into the above aqueous medium, and the resultant mixture was stirred under an $N_2$ atmosphere for 15 minutes at 12,000 rpm with a CLEARMIX apparatus (manufactured by M Technique Co., Ltd.) to produce granules. The temperature of the mixture was then increased to 70° C. at a rate of 0.5° C./minute while stirring with a paddle stirring blade, and the mixture was reacted for 5 hours while maintaining the temperature at 70° C. The temperature was then increased to 90° C., and held at that temperature for 2 hours. After the reaction had finished, the suspension was cooled, and hydrochloric acid was added to dissolve the $Ca_3(PO_4)_2$. The resultant product was filtered, washed and dried to obtain magnetic toner base particles 12. The properties of the obtained magnetic toner base particles are shown in Table 1.

TABLE 1

| | Resin Composition | Magnetic Material (parts) | Post-Classification Treatment Step | Average Circularity | Volumetric Specific Heat (J/($cm^3$ · ° C.) |
|---|---|---|---|---|---|
| Magnetic Toner Base Particles 1 | Hybrid resin 1: 60 parts Polyester resin 1: 40 parts | 60 | Yes | 0.965 | 3818 |
| Magnetic Toner Base Particles 2 | Hybrid resin 1: 60 parts Polyester resin 1: 40 parts | 75 | Yes | 0.950 | 3918 |
| Magnetic Toner Base Particles 3 | Hybrid resin 1: 60 parts Polyester resin 1: 40 parts | 85 | Yes | 0.965 | 3977 |
| Magnetic Toner Base Particles 4 | Hybrid resin 1: 60 parts Polyester resin 1: 40 parts | 90 | Yes | 0.965 | 4003 |
| Magnetic Toner Base Particles 5 | Hybrid resin 1: 60 parts Polyester resin 1: 40 parts | 95 | Yes | 0.950 | 4102 |
| Magnetic Toner Base Particles 6 | Hybrid resin 1: 60 parts Polyester resin 1: 40 parts | 100 | Yes | 0.950 | 4230 |
| Magnetic Toner Base Particles 7 | Hybrid resin 1: 100 parts | 35 | Yes | 0.950 | 3412 |

TABLE 1-continued

| | Resin Composition | Magnetic Material (parts) | Post-Classification Treatment Step | Average Circularity | Volumetric Specific Heat (J/(cm$^3$ · ° C.) |
|---|---|---|---|---|---|
| Magnetic Toner Base Particles 8 | Hybrid resin 1: 100 parts | 40 | Yes | 0.950 | 3450 |
| Magnetic Toner Base Particles 9 | Hybrid resin 1: 100 parts | 45 | No | 0.945 | 3490 |
| Magnetic Toner Base Particles 10 | Hybrid resin 1: 100 parts | 60 | Yes | 0.965 | 3550 |
| Magnetic Toner Base Particles 11 | Hybrid resin 1: 100 parts | 65 | Yes | 0.965 | 3620 |
| Magnetic Toner Base Particles 12 | | 95 | No | 0.970 | 4102 |

<Production Example of Organic-Inorganic Composite Fine Particles 1 to 10>

The organic-inorganic composite fine particles can be produced based on the descriptions in the examples of WO2013/063291.

As the organic-inorganic composite fine particles used in the following examples, organic-inorganic composite fine particles produced based on the examples in WO2013/063291 were readied using the silica illustrated in Table 2. The properties of organic-inorganic composite fine particles 1 to 10 are shown in Table 2.

<Production Example of Organic Particles 1>

A 2-L flask equipped with a stirring device was charged with 860 parts by mass of ion-exchanged water, 6 parts by mass of a non-ionic surfactant (Nonipol 400, manufactured by Sanyo Chemical Industries, Ltd.), and 10 parts by mass of an anionic surfactant (NeoGen SC, manufactured by Dai-ichi Kogyo Seiyaku Co., Ltd.), and the resultant mixture was stirred. The contents of the flask were simultaneously purged with nitrogen to make the flask have a nitrogen atmosphere. Next, the flask was charged with a monomer composition obtained by mixing the following materials.

| | |
|---|---|
| Methacrylic acid | 66 parts by mass |
| Divinylbenzene | 5 parts by mass |

The temperature was increased to 60° C. while stirring the contents of the flask to produce organic-inorganic composite emulsified particles.

Then, as a polymerization initiator, 10 parts by mass of a 50% by mass solution of 2,2'-azobis(2,4-dimethylvaleronitrile) in toluene was added to the stirred emulsified particle solution, and the resultant mixture was held for 4 hours at 60° C. to react. Then, the mixture was heated to increase the temperature to 80° C., and held for 2 hours at 80° C. After cooling to room temperature, the product was dried to obtain organic particles 1.

<Other External Additives>

The properties of the large-diameter external additive used in the following toner production examples other than the above-described external additives are shown in Table 2.

TABLE 2

| | Colloidal Silica | | Properties | | | | |
|---|---|---|---|---|---|---|---|
| | Particle Diameter (nm) | Added Amount (wt. %) | Number Average Particle Diameter (nm) | SF-1 | SF-2 | Volumetric Specific Heat (kJ/(m$^3$ · ° C.) | Colloidal Silica wt. % |
| Organic-Inorganic Composite Fine Particles 1 | 25 | 66 | 95 | 114 | 116 | 4151 | 75% |
| Organic-Inorganic Composite Fine Particles 2 | 25 | 57 | 109 | 118 | 112 | 3292 | 68% |
| Organic-Inorganic Composite Fine Particles 3 | 15 | 58 | 83 | 119 | 102 | 3400 | 60% |
| Organic-Inorganic Composite Fine Particles 4 | 15 | 52 | 62 | 121 | 101 | 3009 | 59% |
| Organic-Inorganic Composite Fine Particles 5 | 25 | 45 | 130 | 113 | 106 | 2950 | 59% |
| Organic-Inorganic Composite Fine Particles 6 | 25 | 49 | 143 | 115 | 109 | 3390 | 62% |

TABLE 2-continued

| | Colloidal Silica | | Properties | | | | |
|---|---|---|---|---|---|---|---|
| | Particle Diameter (nm) | Added Amount (wt. %) | Number Average Particle Diameter (nm) | SF-1 | SF-2 | Volumetric Specific Heat (kJ/(m$^3$ · ° C.) | Colloidal Silica wt. % |
| Organic-Inorganic Composite Fine Particles 7 | 50 | 56 | 159 | 110 | 117 | 4198 | 75% |
| Organic-Inorganic Composite Fine Particles 8 | 15 | 46 | 153 | 110 | 102 | 3009 | 60% |
| Organic-Inorganic Composite Fine Particles 9 | 25 | 69 | 90 | 110 | 105 | 4191 | 75% |
| Organic-Inorganic Composite Fine Particles 10 | 25 | 28 | 335 | 110 | 106 | 2521 | 55% |
| Organic Particles 1 | — | — | 95 | 100 | 100 | 2878 | — |
| EPOSTAR S manufactured by Nippon Shokubai Co., Ltd. | — | — | 150 | 100 | 100 | 4144 | — |
| Sol-Gel Silica particles | — | — | 110 | 110 | 120 | 3775 | — |
| Titanium Oxide Fine Particles | — | — | 270 | 112 | 155 | 6349 | — |

One-point-one parts by mass of organic-inorganic composite fine particles 1 and 0.5 parts by mass of hydrophobic silica fine particles that had been surface treated with a hexamethyl silane coupling agent (primary particle number average particle diameter: 10 nm) were added to 100.0 parts by mass of magnetic toner base particles, and the resultant mixture was mixed for 2 minutes at 3,200 rpm with a Henschel™ mixer to obtain magnetic toner 1. The properties of magnetic toner 1 are shown in Table 3.

<Production Example of Magnetic Toner 2 to 20>

Magnetic toners 2, 4, 9, 15, 17-18 and 20 were obtained in the same manner as magnetic toner 1, except that the type and added amount of the used magnetic toner base particles and large-diameter external additive, and the added amount of the hydrophobic silica fine particles, were changed as shown in Table 3. The properties of the obtained magnetic toners 2, 4, 9, 15, 17-18 and 20 are shown in Table 3.

TABLE 3

| | | Large-Diameter External Additive | | | | | | Hydrophobic Silica Fine Powder | | Volumetric Specific Heat (Large-Diameter | Toner Properties | | |
|---|---|---|---|---|---|---|---|---|---|---|---|---|---|
| Magnetic Toner No. | Toner base particles No. | Type | Added Amount (parts by mass) | Content (parts by mass) | Number Average Particle Diameter (nm) | SF - 1 | SF - 2 | Added Amount (parts by mass) | Content (parts by mass) | External Additive - Toner base particles) (kJ/(m$^3$ · ° C.) | Adhesive Strength (N) | TE (mJ) | External Additive Specific Heat (kJ/(m$^3$ · ° C.) |
| 1 | 1 | Organic-Inorganic Composite Fine Particles 1 | 1.10 | 1.09 | 95 | 114 | 116 | 0.50 | 0.48 | 333 | 0.50 | 129 | 3889 |
| 2 | 2 | Organic-Inorganic Composite Fine Particles 2 | 1.10 | 1.08 | 108 | 118 | 112 | 0.50 | 0.49 | −626 | 0.50 | 103 | 3979 |

TABLE 3-continued

| | | Large-Diameter External Additive | | | | | | Hydrophobic Silica Fine Powder | | Volumetric Specific Heat (Large-Diameter | Toner Properties | | |
|---|---|---|---|---|---|---|---|---|---|---|---|---|---|
| Magnetic Toner No. | Toner base particles No. | Type | Added Amount (parts by mass) | Content (parts by mass) | Number Average Particle Diameter (nm) | SF - 1 | SF - 2 | Added Amount (parts by mass) | Content (parts by mass) | External Additive - Toner base particles) (kJ/(m$^3$ · ° C.) | Adhesive Strength (N) | TE (mJ) | External Additive Specific Heat (kJ/(m$^3$ · ° C.) |
| 3 | 11 | Organic-Inorganic Composite Fine Particles 3 | 1.10 | 1.09 | 72 | 101 | 101 | 0.80 | 0.78 | −220 | 0.41 | 117 | 3694 |
| 4 | 10 | Organic-Inorganic Composite Fine Particles 4 | 1.10 | 1.08 | 63 | 121 | 101 | 0.30 | 0.29 | −541 | 0.56 | 109 | 3598 |
| 5 | 3 | Organic-Inorganic Composite Fine Particles 1 | 1.10 | 1.08 | 95 | 109 | 106 | 0.50 | 0.48 | 174 | 0.50 | 127 | 4048 |
| 6 | 4 | Organic-Inorganic Composite Fine Particles 1 | 1.10 | 1.09 | 94 | 109 | 105 | 0.50 | 0.49 | 148 | 0.50 | 115 | 4074 |
| 7 | 1 | Organic-Inorganic Composite Fine Particles 2 | 0.50 | 0.49 | 107 | 111 | 106 | 0.20 | 0.19 | −526 | 0.65 | 138 | 3844 |
| 8 | 2 | Organic-Inorganic Composite Fine Particles 1 | 2.00 | 1.99 | 96 | 109 | 106 | 1.10 | 1.10 | 233 | 0.23 | 94 | 4056 |
| 9 | 9 | Organic-Inorganic Composite Fine Particles 5 | 0.50 | 0.48 | 131 | 114 | 106 | 0.20 | 0.20 | −540 | 0.65 | 152 | 3515 |
| 10 | 12 | Organic-Inorganic Composite Fine Particles 6 | 2.00 | 1.98 | 142 | 109 | 104 | 1.10 | 1.08 | −712 | 0.23 | 85 | 4225 |
| 11 | 1 | Organic-Inorganic Composite Fine Particles 7 | 0.50 | 0.49 | 153 | 121 | 102 | 1.10 | 1.09 | 380 | 0.37 | 133 | 3894 |
| 12 | 1 | Organic-Inorganic Composite Fine Particles 1 | 0.45 | 0.45 | 96 | 110 | 104 | 1.10 | 1.09 | 333 | 0.37 | 97 | 3892 |
| 13 | 5 | Organic-Inorganic Composite Fine Particles 8 | 1.10 | 1.10 | 250 | 111 | 120 | 0.50 | 0.49 | −1093 | 0.50 | 136 | 4160 |
| 14 | 8 | Organic-Inorganic Composite Fine Particles 9 | 1.10 | 1.09 | 96 | 110 | 107 | 0.50 | 0.48 | 741 | 0.50 | 122 | 3521 |
| 15 | 6 | Organic Particles 1 | 1.10 | 1.08 | 96 | 101 | 100 | 0.50 | 0.49 | −86 | 0.62 | 202 | 4301 |
| 16 | 7 | Organic-Inorganic Composite Fine Particles 1 | 1.10 | 1.08 | 95 | 108 | 105 | 0.50 | 0.50 | 739 | 0.50 | 129 | 3483 |

TABLE 3-continued

| Magnetic Toner No. | Toner base particles No. | Large-Diameter External Additive: Type | Added Amount (parts by mass) | Content (parts by mass) | Number Average Particle Diameter (nm) | SF - 1 | SF - 2 | Hydrophobic Silica Fine Powder: Added Amount (parts by mass) | Content (parts by mass) | Volumetric Specific Heat (Large-Diameter External Additive - Toner base particles) (kJ/(m³ · ° C.) | Toner Properties: Adhesive Strength (N) | TE (mJ) | External Additive Specific Heat (kJ/(m³ · ° C.) |
|---|---|---|---|---|---|---|---|---|---|---|---|---|---|
| 17 | 5 | Inorganic Particles 1 | 1.10 | 1.09 | 271 | 112 | 155 | 0.50 | 0.49 | 2247 | 0.21 | 83 | 4197 |
| 18 | 9 | Organic Particles 2 | 1.10 | 1.09 | 152 | 101 | 101 | 0.50 | 0.48 | −612 | 0.68 | 221 | 3547 |
| 19 | 1 | Organic-Inorganic Composite Fine Particles 10 | 1.10 | 1.08 | 152 | 115 | 106 | 0.50 | 0.49 | −1297 | 0.50 | 198 | 3871 |
| 20 | 1 | Inorganic Particles 2 | 1.10 | 1.07 | 111 | 112 | 120 | 0.50 | 0.49 | −43 | 0.38 | 129 | 3885 |

Example 1 will now be described. The magnetic toner 1 was evaluated as follows. The evaluation results are shown in Table 4.

<Evaluation of Toner Durability Performance and of Parts Welding and Parts Contamination>

An HP LaserJet Enterprise 600 M603dn (manufactured by HP) modified to have a process speed of 400 mm/s, which is faster than the original process speed, was used.

A predetermined process cartridge was filled with 982 g of magnetic toner 1. An image print test on a total of 5,000 sheets was performed in a mode that temporarily stopped the machine between jobs before starting the next job. This test was carried out by defining two sheets having a horizontal line pattern with a 1% printing ratio as one job. The image density of the 25,000-th sheet and the 50,000-th sheet was measured, and the occurrence of image defects was simultaneously confirmed. The evaluation was performed under severe high-temperature high-humidity environmental conditions (32.5° C., 85% RH) that accelerate the embedding of the external additives due to the softening of the binder resin.

The image density was measured as the reflected density of a 5 mm round, solid black image using a SP1 filter with a MacBeth densitometer (manufactured by GretagMacbeth), which is a reflection densitometer. The larger that numerical value the better the developing properties. The specific evaluation criteria were as follows.

A: Very good (1.45 or higher)

B: Good (1.40 or higher to less than 1.45)

C: Normal (1.35 or higher to less than 1.40)

D: Poor (less than 1.35)

Further, at the same time as checking the image density, the level of toner welding to the developing sleeve was evaluated by visually confirming the presence of vertical streaks on the output solid black image. If toner welds to the developing sleeve surface, the toner cannot be charged at the welded site, so that developing defects occur. This causes white streaks in the vertical direction of the output image. The specific evaluation criteria were as follows.

A: No vertical streaks observed

B: Density at the edge regions of the image worse than the center portion

C: Tiny vertical streaks observed at the edge regions of the image

D: Clear vertical streaks observed at the edge regions of the image

In addition, the level of contamination of the electrostatic latent image carrier from the toner was evaluated by visually confirming the presence of white dots on a solid black image output at the same time as the checking of the image density. If an external additive detaches from the toner base particles during prolonged use, clumps form on the electrostatic latent image carrier, which makes it harder to develop the toner at those regions. This causes white-dot image defects. The specific evaluation criteria were as follows.

A: No white-dot image defects

B: Less than 5 white-dot image defects

C: Five or more but less than 10 white-dot image defects

D: Ten or more white-dot image defects

<Evaluation of Low-Temperature Fixability>

An HP LaserJet Enterprise 600 M603dn (manufactured by HP) was modified so that the fixing temperature of the fixing device could be freely set.

Using this apparatus, a half-tone image was output on bond paper (basis weight 75 g/m$^2$) so that the image density was 0.60 to 0.65 by adjusting the temperature in 5° C. intervals over a fixing device temperature of 170° C. or more to 220° C. or less. The obtained images was rubbed 5 times back-and-forth with lens cleaning paper on which a 4.9 kPa load was applied, and the rate of decrease in image density before and after the rubbing was measured. The low-temperature fixability was evaluated by calculating the temperature at which the rate of decrease in density reaches 10% based on the relationship between fixing temperature and rate of decrease in density. The lower this temperature, the better the low-temperature fixability. Image output was performed under low-temperature, low-humidity environmental conditions (7.5° C./15% RH) under which it is harder for the whole fixing device to warm up, so that it is harder for low-temperature fixing to occur.

<Evaluation of Resistance to Discharged Sheet Sticking>

In the evaluation of resistance to discharged sheet sticking, an HP LaserJet Enterprise 600 M603dn (manufactured by HP) modified to have a process speed of 400 mm/s was used. First, a 10 sheet continuous print test was carried out on both sides of Office Planner A4 paper (basis weight 68 g/m$^2$) using a test chart with a 6% print ratio. Then, seven stacks of unopened Office Planner sheets (500 sheets per stack, total of 3,500 sheets) were placed for 1 hour on top of 10 sheets stacked together, and the state of the 10 sheets when the seven stacks were removed was evaluated. The evaluation was performed under severe high-temperature high-humidity environmental conditions (32.5° C., 85% RH) for resistance against discharged sheet sticking. The evaluation criteria for resistance against discharged sheet sticking were as follows.

A: No discharged sheet sticking

B: Although some sheets stuck together, no defects in the images were seen when peeled apart C: Although some defects in the images were seen when peeled apart, such defects were not at a level that would be a problem in practice D: Severe defects in the images were seen when peeled apart <Evaluation of Hot Offset Resistance>

In the evaluation of hot offset resistance, an HP LaserJet Enterprise 600 M603dn was modified so that its process speed was 320 mm/s and so that the fixing temperature of the fixing device could be freely set. Using this apparatus, a solid black image was output on plain paper (basis weight 75 g/m$^2$) while adjusting the temperature in 5° C. intervals over a fixing device temperature of 190° C. or more to 240° C. or less. Soiling caused by offset development on the obtained image was visually confirmed, and the lowest temperature at which soiling occurred was used for the offset resistance evaluation. The higher this temperature is, the better offset resistance is.

Examples 2, 4, and 9

In Example 1, the same evaluations were performed using magnetic toners 2, 4 and 9. The evaluation results are shown in Table 4.

Comparative Examples 3, 5, 6 and 8

In Comparative Examples 3, 5-6 and 8, the same evaluations as performed in Example 1 were performed using magnetic toners 15, 17-18 and 20. The evaluation results are shown in Table 4.

TABLE 4

| | High-Temperature High-Humidity Resistance | | | | | | Low-Temperature Environment | High-Temperature | High- |
|---|---|---|---|---|---|---|---|---|---|
| | Image Density | | Vertical direction White Streaks | | White-Dote Image Defect | | Low-Temperature | Environment Discharged | Temperature Offset |
| | 25,000-th Sheet | 50,000-th Sheet | 25,000-th Sheet | 50,000-th Sheet | 25,000-th Sheet | 50,000-th Sheet | Fixability (° C.) | Sheet Sticking | Resistance (° C.) |
| Example 1 | A (1.45) | A (1.42) | A | A | A (0) | A (0) | A (204) | A | A (245) |
| Example 2 | A (1.45) | A (1.41) | A | A | A (0) | A (0) | A (201) | A | A (245) |
| Example 3 | A (1.46) | A (1.42) | A | A | A (0) | A (0) | B (206) | A | A (245) |
| Example 4 | B (1.37) | C (1.32) | A | C | A (0) | A (0) | A (201) | A | C (220) |
| Example 5 | A (1.42) | A (1.41) | A | A | A (0) | A (0) | A (202) | A | A (240) |
| Example 6 | A (1.43) | A (1.41) | A | A | A (0) | A (0) | B (208) | A | A (240) |
| Example 7 | A (1.42) | B (1.36) | A | B | A (0) | A (0) | A (203) | A | A (240) |
| Example 8 | A (1.46) | A (1.40) | A | A | A (0) | B (2) | A (201) | A | A (240) |
| Example 9 | C (1.34) | C (1.30) | B | C | A (0) | A (0) | A (204) | A | B (225) |
| Example 10 | A (1.50) | C (1.31) | A | B | A (0) | C (8) | C (212) | A | A (240) |
| Example 11 | A (1.46) | B (1.35) | A | A | A (0) | B (3) | C (214) | A | A (240) |
| Example 12 | A (1.45) | B (1.35) | A | A | A (0) | C (7) | B (207) | A | A (235) |
| Comparative Example 1 | D (1.29) | D (1.19) | D | D | A (0) | A (0) | B (207) | A | A (235) |
| Comparative Example 2 | A (1.45) | B (1.36) | A | B | A (0) | A (0) | D (219) | D | A (235) |
| Comparative Example 3 | D (1.29) | D (1.11) | D | D | A (0) | A (0) | D (218) | A | A (230) |
| Comparative Example 4 | D (1.28) | D (1.05) | D | D | A (0) | A (0) | A (203) | A | D (215) |
| Comparative Example 5 | C (1.32) | C (1.30) | A | A | D (12) | D (11) | D (220) | D | A (230) |
| Comparative Example 6 | D (1.28) | D (1.10) | D | D | A (0) | A (0) | A (204) | A | A (230) |
| Comparative Example 7 | D (1.26) | D (1.05) | D | D | D (13) | D (17) | D (217) | A | A (230) |
| Comparative Example 8 | A (1.45) | A (1.41) | A | A | C (7) | D (21) | D (219) | A | A (230) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-159296 filed Jul. 31, 2013, which is hereby incorporated by reference herein in its entirety.

What is claimed is:

1. A toner comprising toner base particles, each of which contains a binder resin and a magnetic material, and organic-inorganic composite fine particles on each of the toner base particles, wherein each of the organic-inorganic composite fine particles comprises a vinyl resin particle, and inorganic fine particles which are embedded in the vinyl resin particle, and at least a part of which are exposed, wherein the toner base particles have a volumetric specific heat at 80° C. of 3,450 kJ/($m^3$·° C.) or more to 4,200 kJ/($m^3$·° C.) or less, wherein the organic-inorganic composite fine particles have a volumetric specific heat at 80° C. of 2,900 kJ/($m^3$·° C.) or more to 4,200 kJ/($m^3$·° C.) or less, and a number average particle diameter of 50 nm or more to 200 nm or less, and wherein an absolute difference between the volumetric specific heat at 80° C. of the toner base particles and the volumetric specific heat at 80° C. of the organic-inorganic composite fine particles is 740 kJ/($m^3$·° C.) or less.

2. The toner according to claim 1, wherein a maximum tensile stress when a toner layer formed by applying on the toner a compressive stress of 8 kg/$cm^2$ fractures is 0.40 N or more to 0.60 N or less.

3. The toner according to claim 1, wherein each of the organic-inorganic composite fine particles has the vinyl resin particle as a base particle, and has a structure with convex portions derived from the inorganic fine particles on a surface of the vinyl resin particle, and the organic-inorganic composite fine particles have a shape factor SF-1 of 100 or more to 150 or less and a shape factor SF-2 of 103 or more to 120 or less.

4. The toner according to claim 1, wherein the organic-inorganic composite fine particles have a volumetric specific heat at 80° C. of 2,900 kJ/($m^3$·° C.) or more to 3,100 kJ/($m^3$·° C.) or less.

5. The toner according to claim 1, wherein the organic-inorganic composite fine particles have a number average particle diameter of 70 nm or more to 130 nm.

6. The toner according to claim 1, wherein the toner base particles have a volumetric specific heat at 80° C. of 3,600 kJ/($m^3$·° C.) or more to 4,000 kJ/($m^3$·° C.) or less.

7. The toner according to claim 1, wherein the toner base particles have an average circularity of 0.950 or more to 0.965 or less.

8. The toner according to claim 1, wherein 0.50 parts by mass or more to 2.00 parts by mass or less of the organic-inorganic composite fine particles are added based on 100 parts by mass of toner base particles.

9. The toner according to claim 1, wherein the inorganic fine particles are silica fine particles.

10. The toner according to claim 1, wherein the inorganic fine particles have a number average particle diameter of 10 nm or more to 100 nm.

* * * * *